US006173456B1

(12) United States Patent
Nieto

(10) Patent No.: US 6,173,456 B1
(45) Date of Patent: Jan. 16, 2001

(54) DOUBLE-CISTERN WATER-CONSERVING SANITARY WATER TANK

(76) Inventor: German Nieto, 1306 E. Hawtorne Cir., Hollywood, FL (US) 33021

( * ) Notice: Under 35 U.S.C. 154(b), the term of this patent shall be extended for 0 days.

(21) Appl. No.: 09/265,009

(22) Filed: Mar. 9, 1999

(30) Foreign Application Priority Data

Mar. 11, 1998 (CO) ..... 98013328

(51) Int. Cl.[7] ..... E03D 1/22
(52) U.S. Cl. ..... 4/363; 4/324; 4/326
(58) Field of Search ..... 4/363, 324, 325, 4/326, 364, 356, 415, 665, 353; 137/101.25, 101.27, 87.02, 115.03; D23/295, 309, 313

(56) References Cited

U.S. PATENT DOCUMENTS

D. 390,934 * 2/1998 McKeone ..... D23/295
1,805,204 * 5/1931 Brown ..... 4/326
3,903,550 * 9/1975 Wilhelm ..... 4/34
5,548,850 * 8/1996 Geeham ..... 4/363

* cited by examiner

*Primary Examiner*—Henry J. Recla
*Assistant Examiner*—Huyen Le

(57) ABSTRACT

A double-cistern water conservation sanitary water tank comprises two tanks: an external oval tank (9) for evacuating solid waste and an internal round tank (8) for flushing liquid waste mounted within and at a level above a bottom wall of the external oval tank (9), and two actuating handle for operating the tanks. The external oval tank (9) includes a water entrance valve (3) and an elbow-shaped water outlet (4) having one end connected to a first outlet valve (11) inside the external oval tank (9). The internal round tank (8) includes a water entrance valve (1) and a vertical water outlet (2) having one end connected a second outlet valve (10), an intermediate portion connected to the second end of the elbow-shaped water outlet (4), and the other end forming a common drain (7).

2 Claims, 9 Drawing Sheets

DOUBLE-CISTERN WATER-CONSERVING SANITARY WATER TANK

FIELD OF THE INVENTION

Figure 1:
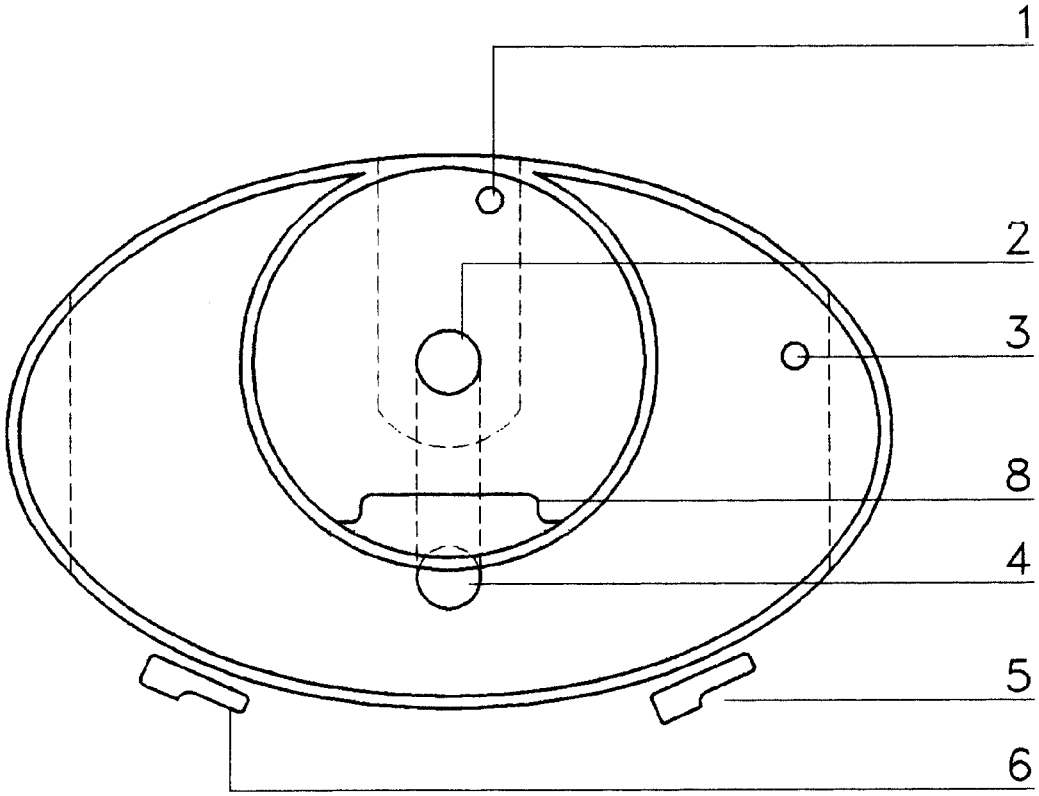

The "Double-Cistern Water-Conserving Sanitary Water Tank" is a device which is made up of two (2) independent tanks or recipients, one inside the other, totally or partially, at the same or different levels and with different capacities; one (1) six-liter tank is used for evacuating solid matter (i.e., Feces), and the other four-liter tank is used for evacuating liquid matter (i.e., Urine), thus allowing the conservation of two (2) liters of water with each flush when the latter tank is used.

This non-provisional use Patent Model consists of a lower six-liter recipient or tank which is semi-oval in shape and has a greater transversal diameter; the lower surface is flat and is the location of the only drain outlet. On this veneer, there is also an opening to permit the water tank to be fastened to the Toilet Bowl. At either end of each side, the lower surface slopes up at an angle, joining with and rising as the side walls. Both recipients touch at the front-to-back diameter. The water-outlet valve of the lower tank is attached laterally to the drain, taking on an elbow-shape, which connects to the drain of the upper tank to form a single outlet, which flows into the Toilet Bowl.

Inside the [larger] lower tank, yet located at a different level, is the four-liter tank meant for the evacuation of liquid matter (i.e., Urine) from the Toilet Bowl.

This inner tank is cylindrical in shape and has a base or lower surface with one opening for the water entry valve and another, which has a small prolongation upwards, forming a lateral pair of slits where the water-output valve is fitted. The lower-front part of this recipient has a notch to allow the water-output valve stopper to be completely lifted. If the base of this recipient has a higher level, this notch is not present, since the stopper of the water-outlet valve can open freely in this case.

On the upper part of the front surface and laterally, there are two (2) openings for the handles which allow the tanks to be emptied independently, as necessary.

It is important to stress that this Double-Cistern Sanitary Water Tank works only with Water-Conserving Toilet Bowls.

INVENTION BACKGROUND

Currently, within the Sanitary Water-Tank/Toilet-Bowl Industry, there are only water tanks having a single tank or recipient, all of which use the same amount or volume of water (12.8 or 6 liters), depending on the model, for evacuating both solid matter (i.e., Feces) or liquids (i.e., Urine) from the Toilet Bowl, which leads to an excessive use of our costly water.

The purpose of this invention is to provide an "Double-Cistern Water-Conserving Sanitary Water Tank" with independent services and different capacities; a six-liter tank for evacuating solid matter (i.e., Feces) and another four-liter tank for evacuating liquids (i.e., Urine) from the Toilet Bowl, thereby allowing the conservation of two (2) liters of water with each flush when the latter tank is used.

This, then, is a Sanitary Water Tank meant to preserve this valuable and scarce natural resource and contributes to the adequate and rationed use of water, promoting ecological awareness and a sensitivity to the wasteful use of water resources.

BRIEF SUMMARY OF THE INVENTION

The purpose of the invention is to supply an "Double-Cistern Water-Conserving Sanitary Water Tank" for the purpose of saving water. The water tank is characterized by actually having two (2) tanks or recipients; a lower one with a six-liter capacity for evacuating solid matter (i.e., Feces) from the Toilet Bowl and another upper tank with a four-liter rapacity for evacuating liquid matter (i.e., Urine) from the same area, as necessary. This allows the independent use of water for each case, permitting a two-liter conservation with each flush when the upper tank is used.

This is a tank with two (2) independent recipients or tanks, one inside the other, totally or partially, at the same level or with one at a slight elevation, which means that the tank lid can be flat or can have two (2) levels. These recipients have different capacities and form a set. Each recipient or tank has independent water intakes and outlets, the latter forming a single drain which leads to the Toilet Bowl. The tank also has two (2) handles, which allow the independent emptying of each recipient or tank, as necessary.

BRIEF DESCRIPTION OF VARIOUS ANGLES OR VIEWS OF ILLUSTRATIONS

FIG. 1 corresponds to a schematic overhead view of the Double-Cistern Water-Conserving Sanitary Water Tank.

Figure 2:
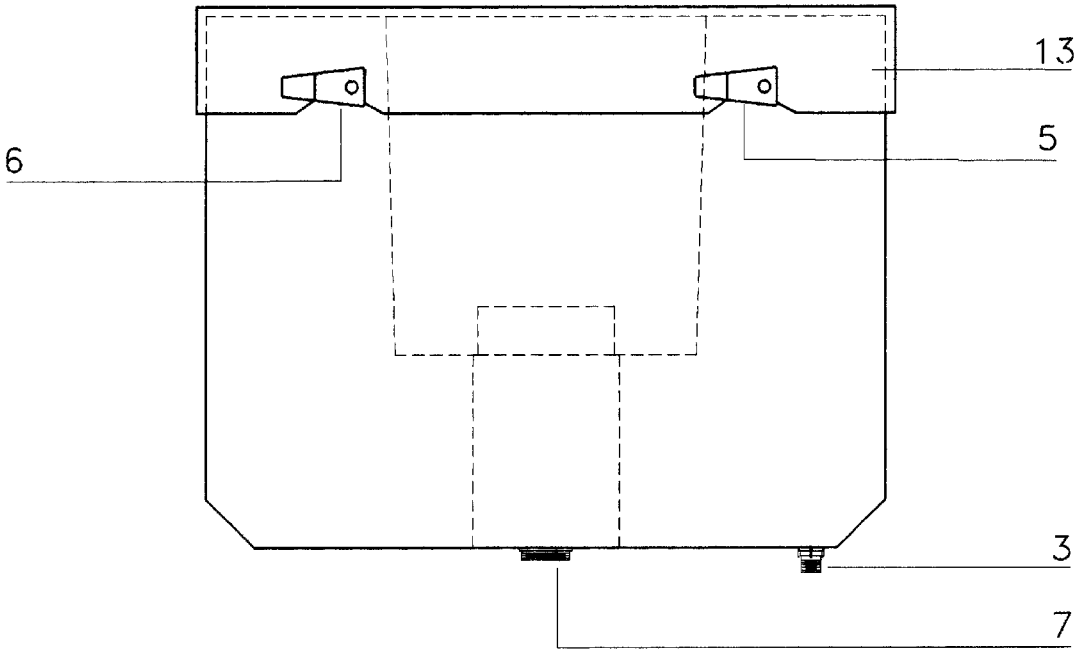

FIG. 2 corresponds to a front schematic view of the Double-Cistern Water-Conserving Sanitary Water Tank.

Figure 3:
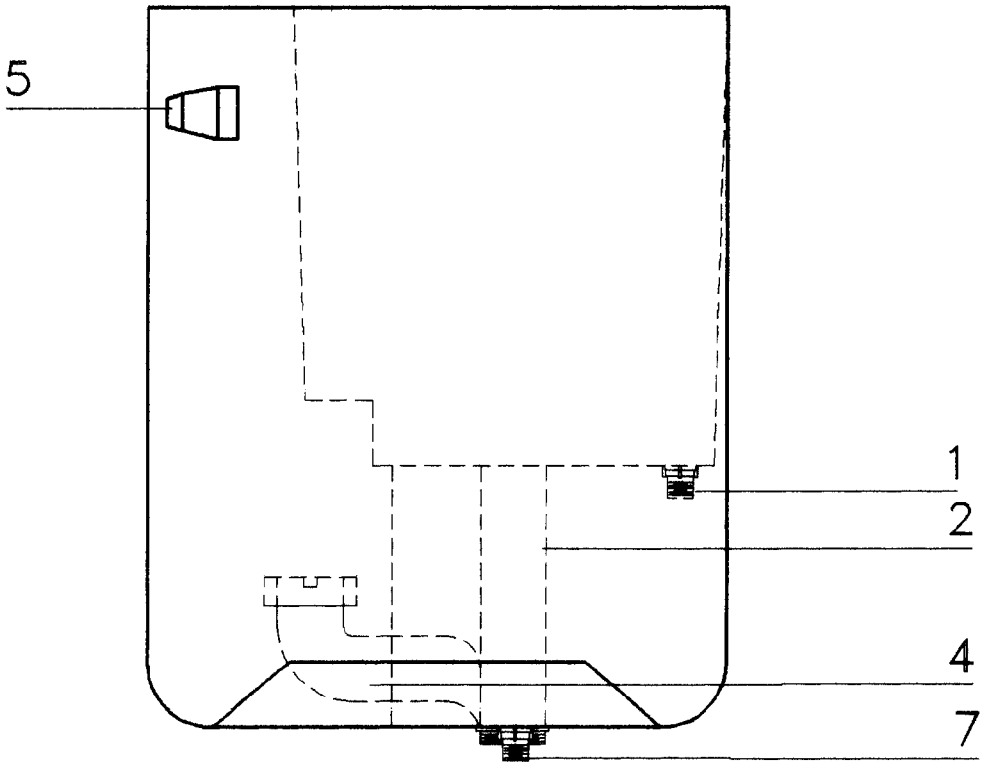

FIG. 3 corresponds to a schematic view of the left side of the Double-Cistern Water-Conserving Sanitary Water Tank.

Figure 4:
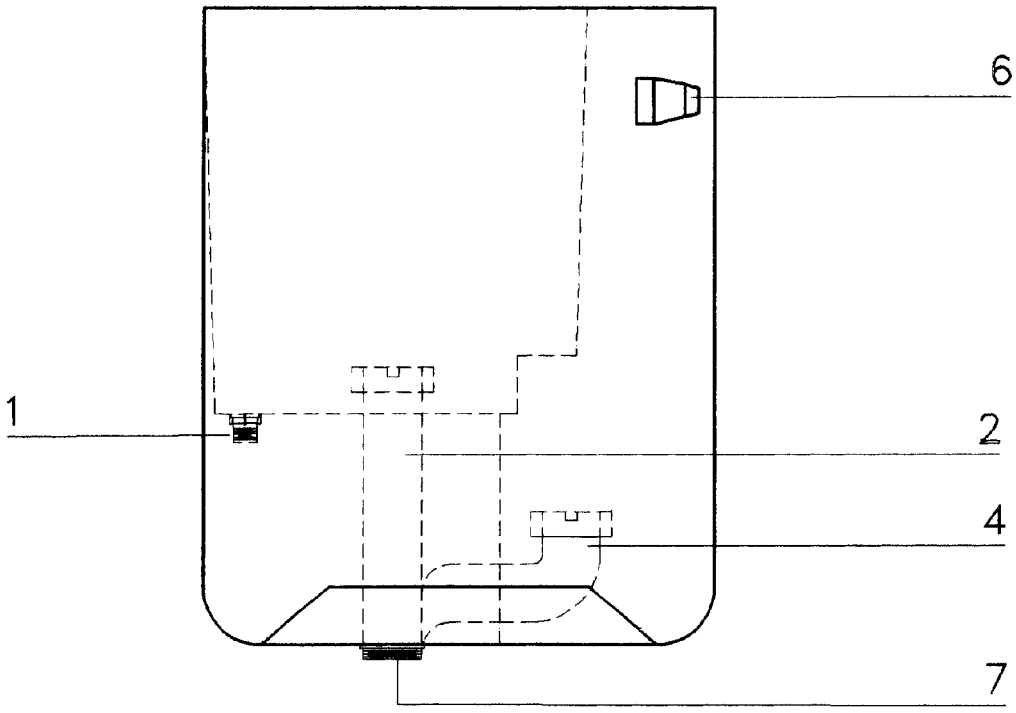

FIG. 4 corresponds to a schematic view of the right side of the Double-Cistern Water-Conserving Sanitary Water Tank.

Figure 5:
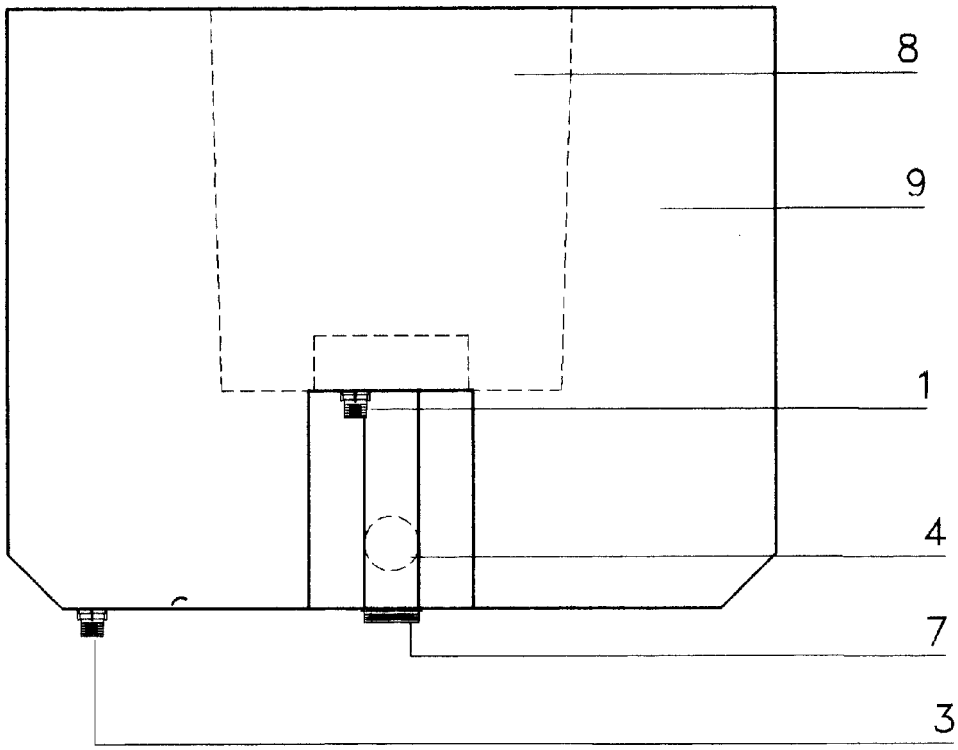

FIG. 5 corresponds to a schematic view of the back of the Double-Cistern Water-Conserving Sanitary Water Tank.

Figure 6:
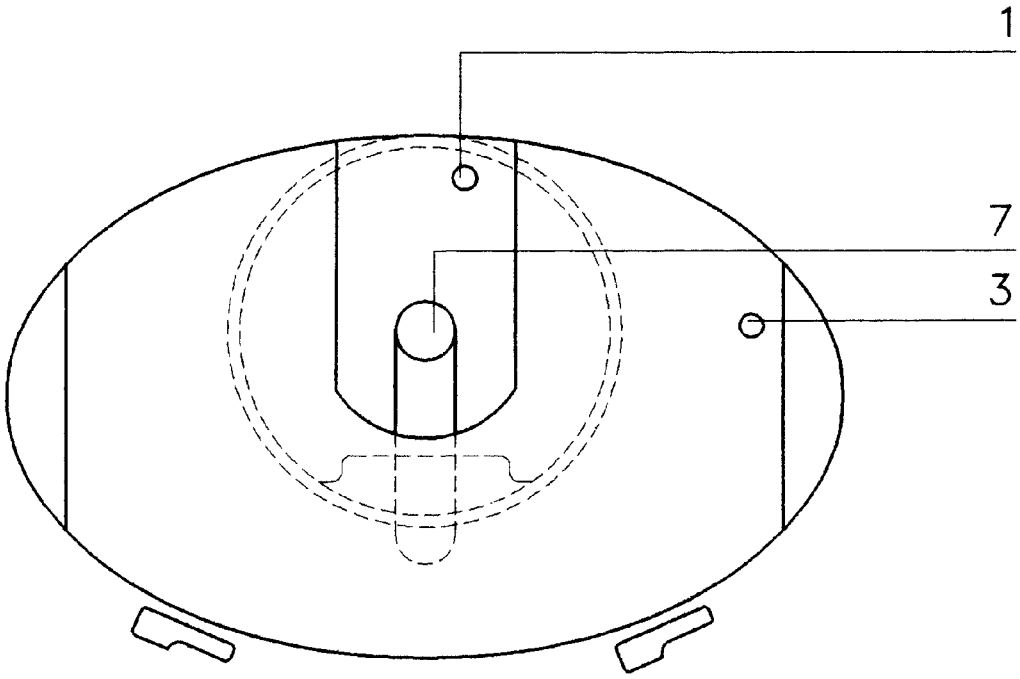

FIG. 6 corresponds to a schematic view from below of the Double-Cistern Water-Conserving Sanitary Water Tank.

Figure 7:
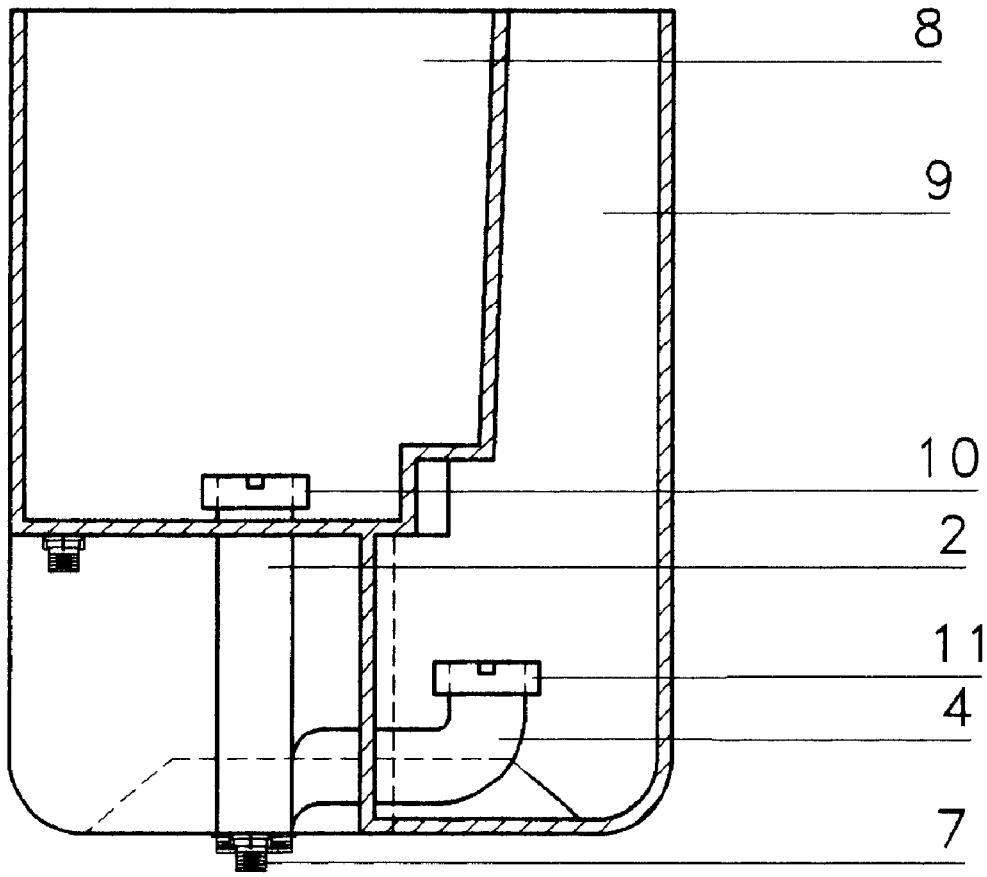

FIG. 7 corresponds to a right cross section of both tanks of the Double-Cistern Water-Conserving Sanitary Water Tank.

Figure 8:
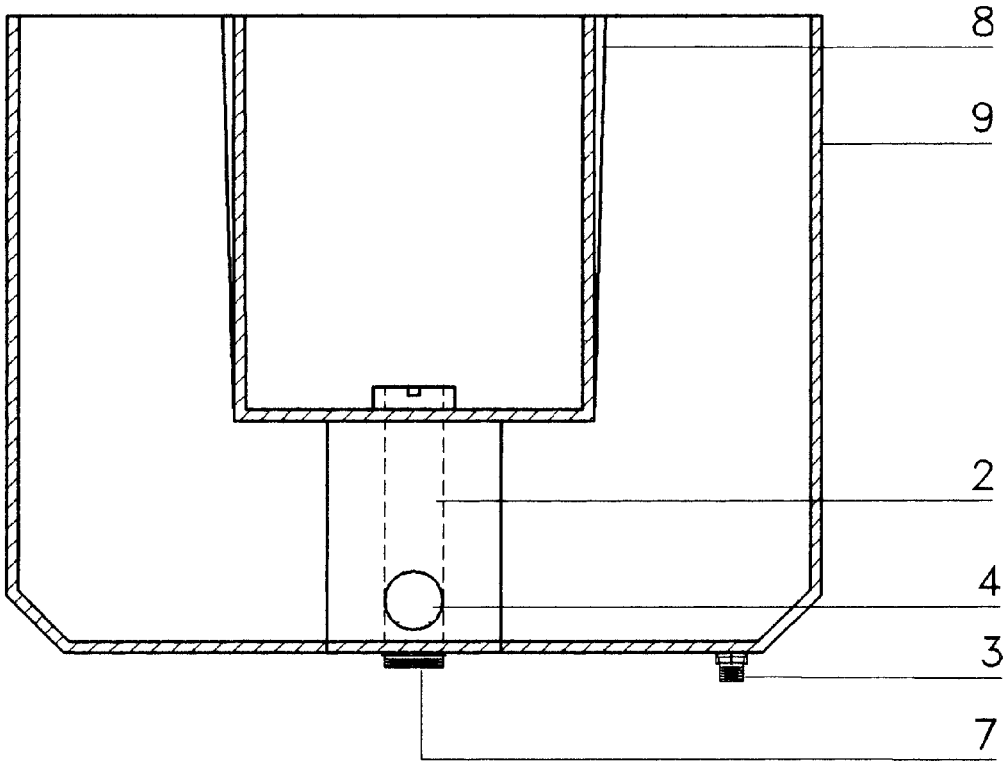

FIG. 8 corresponds to a schematic back view both tanks and their interaction.

Figure 9:
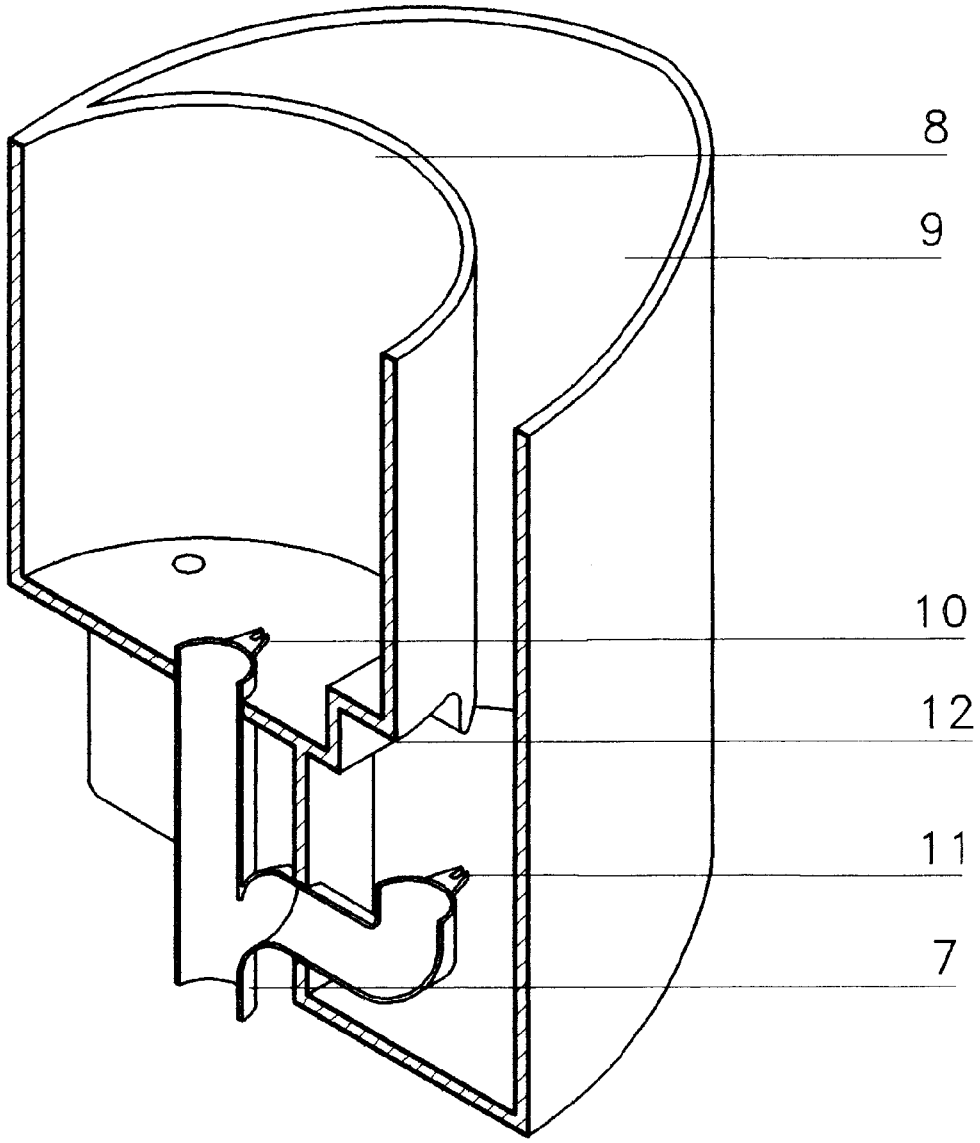

FIG. 9 corresponds to an isometric cross-section of both tanks of the Double-Cistern Water-Conserving Sanitary Water Tank.

DETAILED DESCRIPTION OF THE INVENTION

This "Double-Cistern Water-Conserving Sanitary Water Tank" consists of two (2) independent recipients or tanks, one within the other, totally or partially, at the same level or at different ones, with different capacities, which form a set:

This non-provisional use Patent Model consists of a lower six-liter recipient or tank which is semi-oval in shape and has a greater transversal diameter; the lower surface is flat and is the location of the only drain outlet. On this veneer, there is also an opening for the water-intake valve, as well as two (2) openings to permit the water tank to be fastened to the Toilet Bowl. At either end of each side, the lower surface slopes up at an angle, joining with and rising as the side walls. Both recipients are involved with the front-to-back diameter. The water-outlet valve of the lower tank is attached laterally to the drain, taking on an elbow-shape, which connects to the drain of the upper tank to form a single outlet, which flows into the Toilet Bowl.

Inside the lower tank, yet located at a different level, is the upper four-liter tank meant for the evacuation of liquid matter (i.e., Urine) from the Toilet Bowl.

This inner tank is cylindrical in shape and has a base or lower surface with one (1) opening for the water entry valve and another, which has a small prolongation upwards, forming a lateral pair of slits where the water-output valve is fitted. The lower-front part of this recipient has a notch to allow the water-output valve stopper to be completely lifted. If the base of this recipient is at a higher level, this notch is not present, since the stopper of the water-outlet valve can open freely in this case.

On the upper part of the front surface and laterally, there are two (2) openings for the handles which allow the tanks to be emptied independently, as necessary.

It is important to stress that this Double-Cistern Sanitary Water Tank works only with Water-Conserving Toilet Bowls.

FIG. 1 on Page 1/9 of the illustrations shows a schematic overhead view of the Double-Cistern Water-Conserving Sanitary Water Tank, showing the two 82) recipients or tanks in which No. 1 is the water-intake for the upper tank, and No. 2 is the water outlet for the same tank, which uses four (4) liters to evacuate liquid matter (i.e., Urine) from the Toilet Bowl.

FIG. 2 on Page 2/9 of the illustrations provides a schematic front view of the Double-Cistern Water Tank, where the dotted line corresponds to the upper tank and the place where the water outlets of each tank join to form a common drain; analogously, the water intake of the lower tank is indicated with the No. 3 and the shared drain with the No. 7; the tank lid is denoted with No. 13, and the handles on both tanks with the Nos. 5 and 6.

FIG. 3 on Page 3/9 shows a schematic view of the left side, where an unbroken line shows the lower six-liter tank and the dotted line shows the upper four-liter tank, as well as the interaction of the two (2) tanks; Indicated with Nos. 1 and 2 are the water intake and outlet from the upper tank, respectively in like manner, No. 4 shows the water outlet of the lower tank, and No. 5 indicates the handle for the upper tank, whereas No. 7 shows the common drain.

FIG. 4 on Page 4/9 shows a right-side schematic view, illustrating the interaction of both tanks as well as the water input to the upper tank (shown with No. 1), the water outlet of the same tank (which is No. 2), the water outlet of the lower tank (indicated with No. 4), the handle for the lower tank (as seen in No. 6), and the joint drain (illustrated in No. 7).

FIG. 5 on Page 5/9 [of the illustrations] offers a schematic back view, with the unbroken line indicating the lower tank (No. 9), and where No. 7 is the joint drain; the dotted line shows the upper tank (No. 8) with its notch, the water outlet of the lower tank is shown with No. 4, and Nos. 1 and 3 denote the water intakes of the upper and lower tanks, respectively.

FIG. 6 on Page 6/9 provides a schematic view from below, where Nos. 1 and 3 are the water intakes of the upper and lower tanks, respectively, and No. 7 indicates the shared drain. The unbroken line illustrates the lower tank, and the area where the common drain passes. The dotted line shows the upper tank, the notch and part of the water output of the lower tank.

FIG. 7 on Page 7/9 shows a cross-section of both tanks, the upper one bearing the No. 8 and the lower one, the No. 9. Also show are the interaction between tanks, independent water outlets for the upper and lower tanks, indicated with the Nos. 2 and 4, respectively. In addition, the common drain bears the No. 7, water intake for the upper tank bears the No. 1, and the Nos. 10 and 11 indicate the place where the water outlet vales are fixed to the upper and lower tanks, respectively.

FIG. 8 on Page 8/9 offers a back schematic view of both tanks, the upper bearing the No. 8 and the lower, the No. 9. Also shown are their interaction. The dotted line denotes the water outlet of the upper tank (shown with the No. 2), and the circle with the No. 4 indicates the water outlet of the lower tank; Nos. 3 and 7 correspond respectively to the water intake of the lower tank ant the common drain.

FIG. 9 on Page 9/9 [of the illustrations] shows an isometric cross-section where the four-liter upper tank is shown (No. 8), as is the area where the water outlet valve of that tank is fixed (No. 10). In like manner, the lower six-liter tank is shown (No. 9), the elbow-shaped joint where the water outlet valve is attached (No. 11), as well as the shared drain formed by the union of both water outlets (No. 7), and the notch of the upper tank (No. 12).

I claim that my invention is:

1. A double-cistern water-conserving sanitary water tank system comprising:

an external oval tank having a side walls and a bottom wall, and approximately a 6 liter capacity, a first water entrance valve in the bottom wall of said external oval tank, an elbow-shaped water outlet extending through the side wall of said oval tank and having a first end with a first outlet valve terminating inside the oval tank, two handles extending through the side wall of said external oval tank for flushing the system and;

an internal round tank having a side wall and a bottom wall mounted within said external oval tank at a level above the bottom wall of said external oval tank and having approximately a 4 liter capacity, a segment of the side wall of said internal round tank being integrally formed with the side wall of said external oval tank, a second water entrance valve in the bottom wall of said internal round tank, a vertical water outlet having two ends, one end attached to a second outlet valve at the bottom wall of said internal round tank, said first and second outlet valves operationally connected to said handles, respectively, an intermediate portion of the vertical water outlet attached to a second end of the elbow-shaped water outlet exterior of said external oval tank, a notch formed in the side and bottom walls of said internal round tank to give more opening space to the first outlet valve.

2. The system as in claim 1, wherein the opposite end of the vertical water outlet forms a common drain from said first and second outlet valves.

* * * * *